United States Patent [19]

Silverman et al.

[11] 4,095,537

[45] Jun. 20, 1978

[54] AUTOMATIC HEMMING APPARATUS

[75] Inventors: Seymour Silverman; Kwan Hong Ng, both of New York, N.Y.

[73] Assignee: Silverman Machines Company, New York, N.Y.

[21] Appl. No.: 792,712

[22] Filed: May 2, 1977

[51] Int. Cl.[2] ..... D05B 33/02; D05B 35/02

[52] U.S. Cl. ..... 112/121.29; 112/141; 112/147

[58] Field of Search ..... 112/121.29, 121.11, 112/121.12, 121.15, 147, 152, 153, 141, DIG. 2, DIG. 1

[56] References Cited

U.S. PATENT DOCUMENTS

| | | | |
|---|---|---|---|
| 3,110,232 | 11/1963 | Frei | 112/DIG. 2 X |
| 3,204,591 | 9/1965 | Pickett | 112/147 X |
| 3,544,098 | 12/1970 | Hawley | 112/DIG. 2 X |
| 3,640,235 | 2/1972 | Burton | 112/147 X |
| 3,670,674 | 6/1972 | Conner | 112/121.29 |
| 3,875,879 | 4/1975 | Heiler et al. | 112/121.15 |
| 3,973,506 | 8/1976 | Rinehimer et al. | 112/121.29 |

*Primary Examiner*—H. Hampton Hunter
*Attorney, Agent, or Firm*—James & Franklin

[57] ABSTRACT

Pieces of cuff material are affixed to a continuous band of linear material as the band passes through a sewing machine. A vacuum force is used to hold material in place on the continuous band as the band is moved. The pieces of material are individually manually placed on the band in a manner such that initially only a small portion thereof is attracted by the vacuum force thereby facilitating correct relative positioning of the piece and band such that the edge of the piece overlaps the edge of the band. Folding of the overlapping edge of the piece over the edge of the band is also achieved through use of the vacuum, which pulls the overlapping edge of the piece around the edge of the band and into a slot in the vacuum enclosure, immediately underneath the edge of the band. The folded edge of the material is creased and passed through the sewing machine for stitching. The band is then cut to form the cuff portions which are thereafter stacked.

25 Claims, 5 Drawing Figures

FIG. 4
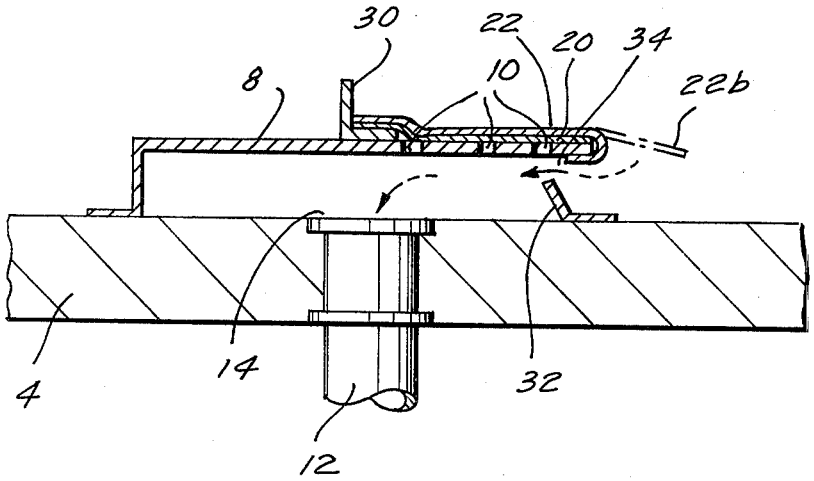
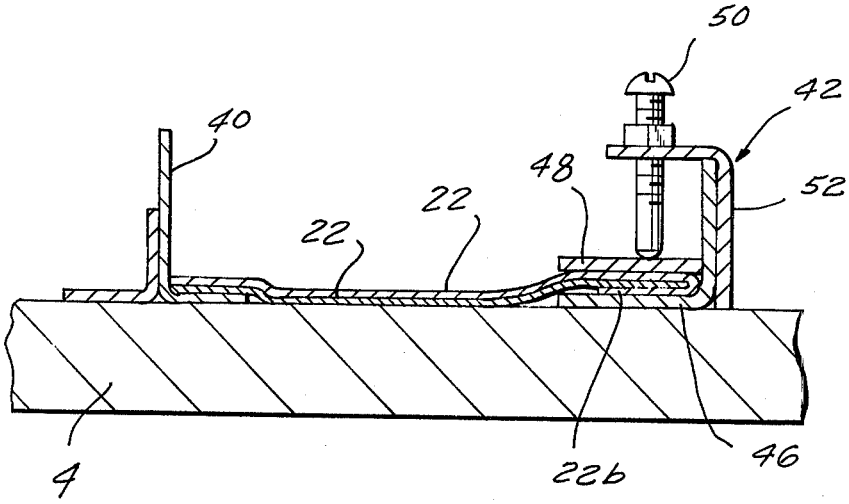
FIG. 5

AUTOMATIC HEMMING APPARATUS

The present invention relates to an apparatus for automatically hemming a piece of fabric to continuous band of liner material to form a cuff or hem any garment part affixed to liner material and, more particularly, to an improved feed and holding apparatus therefor.

In a variety of products involving a sewing operation, particularly in the manufacture of clothing, a piece of one fabric is sewn to a piece of another fabric with the two attached pieces being used to form a part of the finished product. An example of such an operation is involved in the manufacture of shirt cuffs. Each shirt cuff contains a lining between a top layer and a bottom layer of fabric. Conventionally, such a cuff is prepared by first cutting appropriate size strips of lining from a bolt of material, such as canvas. The bolt of lining material has to be carefully layed out in order to utilize it most efficiently. This is a laborious, time-consuming procedure requiring a skilled workman, and still some wastage is unavoidable. Once the lining strips have been prepared, strips of shirt fabric are individually hemmed to each strip of lining. This is also a skilled operation which involves placing one strip of fabric on one strip of lining, folding an edge of the fabric over the lining, and then sewing the two together at the folded side. The attached strips are individually stacked manually to await the next step in the manufacturing process. Completion of the cuff then involves further work, but its description will not be included herein because the present invention concerns only the above-described portion of the operation. The term "cuff" will be used hereinafter to refer to the product of that portion of the operation described in detail up to this point and which is the finished product of the apparatus of the present invention when used in the manufacture of shirts.

In order to accomplish the above-described operation in a reliable and relatively inexpensive manner which does not require any skilled labor, we have devised an automatic hemming apparatus which is described in detail in our copending application Ser. No. 568,561, filed Apr. 16, 1975, entitled "Automatic Hemming Apparatus", now U.S. Pat. No. 4,040,366 issued Aug. 9, 1977. The apparatus described in this patent is used in combination with the sewing machine for hemming a piece of shirt material to a continuous band of liner material. The band passes through the sewing machine. As each piece is individually placed on the moving band, it passes through a mechanical folder which folds one edge of the piece under the band. The folded edge is then sewn to the band. A strip of the band, carrying the piece of cuff material, is then cut away from the remainder of the band and automatically removed into a stacker. The cutting, moving and stacking operations are actuated by the appropriate sensing apparatus. The sensing apparatus is responsive to the vertical separation between the fabric and the lining which is attained with a separator device. The vertical separation enables reliable operation of the sensing apparatus with all types of materials.

The stacker is comprised of a base supporting two upwardly extending side walls defining a passage therebetween. A ledge, or bracket, attached to each side wall extends into the passage. A portion of the base is vertically movable and fits between the ledges. The vertically movable portion of the base lifts the strip above the ledges and returns to the original position, leaving the strip supported by the ledges. Thus, the only duties of the operator are to place the pieces on the band and to remove the stacked pile of the finished products. Such duties require little skill, eliminating the need for a skilled operator while the automated procedure also results in a significant decrease in production time.

In the above-described machine, it is necessary that the piece of cuff material be accurately positioned with respect to the continuous liner band prior to the folding and subsequent hemming operation to assure the correct relationship between the cuff material and liner in the finished product. To maintain the positional relationship between the piece and band as same are moved through the apparatus, the surface upon which the continuous band passes is provided with a series of apertures which are connected to a vacuum means. The flow of air through these apertures retains the piece of cuff material in the correct position with respect to the continuous liner band as the band is moved into the folding apparatus. Because of the force excited by the vacuum, once the piece of material is placed on the band, it is difficult to move the piece with respect to the band to reposition it. Thus, the operator placing the pieces of cuff material on the band must do so in an accurate manner the first time. This is a drawback in that it requires a certain amount of skill on the part of the machine operator and, therefore, may cause a slowdown of the overall operation.

Folding is accomplished by means of a conventional mechanical folder which comprises a supporting surface upon which the band containing the pieces of cuff material passes and spaced thereabove, a rigid guide having a planar body overhanging the surface with a downwardly extending flange. The overhanging portion of the body is tapered inwardly towards the support surface. At the input end of the folder, the flange is spaced from the edge of the support surface so that the overlapping edge of the piece of material is positioned inside the flange. As the piece of material is moved along the body of the folder, the overhanging edge of the piece is directed first downwardly, and thereafter underneath the edge of the continuous band as the overhanging portion of the body of the guide is tapered along the folder.

This type of mechanical folder has a number of disadvantages which stem from the fact that the dimensions of the guide portion of the folder are normally fixed, thereby severely restricting the range of the width of the continuous band and pieces of material which can be accommodated by the folder. Because of this, mechanical folders of different dimensions have to be used for barrel (button) type cuffs and French cuffs, respectively. Further, the mechanical folder does not permit any substantial variation in the width of the overlapping edge of the piece of material which is folded underneath the band. Thus, the use of mechanical folders severely restricts the dimensions and relative positions of the lining band and pieces of material which can be handled by the automatic hemming apparatus, as well as the structure of the cuffs which are manufactured thereby.

It is, therefore, a prime object of the present invention to provide an improved automatic hemming apparatus wherein the positioning of the pieces of cuff material on the lining band is facilitated.

It is another object of the present invention to provide an improved automatic hemming apparatus which demonstrates improved versatility with respect to the dimensions of the piece of material and lining band upon which it operates and the structure of the cuffs produced thereby.

It is further object of the present invention to provide an improved automatic hemming apparatus which performs the manufacturing operation in a reliable and relatively inexpensive manner, rapidly and without the need for skilled labor.

In accordance with the present invention, the improved hemming apparatus is provided with a vacuum operated folder for folding the overlapping edge of the piece of material over the edge of the continuous liner band. The folder includes an enclosure having a surface supporting the liner band and the piece of material thereon, as the band is moved therethrough. The surface supports the band and piece of material in a face-to-face relationship and a guide is utilized to position the band with the edge thereat adjacent the end of the surface and the edge of the piece of material to be folded in a position wherein it overlaps the end of the surface. An opening or slot along the enclosure situated immediately below the end of the supporting surface opens into the interior of the enclosure which is connected to a vacuum producing apparatus. The vacuum apparatus is effective to create a flow of air into the opening or slot which causes the overlapping edge of the piece of material to be inserted into the opening, thus, folded around the end of the supporting surface and, consequently, around the edge of the liner band.

Immediately prior to the vacuum folder is the portion of the hemming apparatus where the pieces of material are manually placed on the continuous liner band. The aforementioned enclosure is extended such that the supporting surface thereof is the surface whereupon which the placement of the piece of material occurs. A number of apertures are present in this supporting surface and open into the enclosure which is connected to the vacuum means. Air flow through these apertures creates a force causing the pieces of material to be held in position with respect to the continuous band as the band is fed to the folder.

An overhanging shelf with an upstanding guide is situated above the support surface at the point there along where the pieces of material are manually positioned on the band. The pieces of material are placed by the operator on the shelf and, thus, can be positioned with respect to the guide and thus the lining band without interference from the forces created by the vacuum. Placement of the piece of material on the shelf is done in a manner which permits a relatively small portion of the end thereof to overhang the shelf after the piece is positioned with respect to the guide. This position is then situated on the continuous lining band which in turn is located at a point on the supporting surface where the vacuum means is active. The vacuum means creates a force holding the overhanging end of the piece of material to the lining band. As the band is moved, the remainder of the piece of material on the overhanging shelf is removed therefrom by the action of the band and travels with the band. This method of operation considerably facilitates accurate positioning of the piece of material with respect to the liner band.

To the accomplishment of the above and to such other objects as may hereinafter appear, the present invention relates to an improved automatic hemming apparatus, as defined in the appended claims and as described in this specification, taken together with the accompanying drawings in which:

FIG. 4 is a sectional view taken along line 4—4 of FIG. 1; and

FIG. 5 is a sectional view taken along line 5—5 of FIG. 1.

Figure 1:
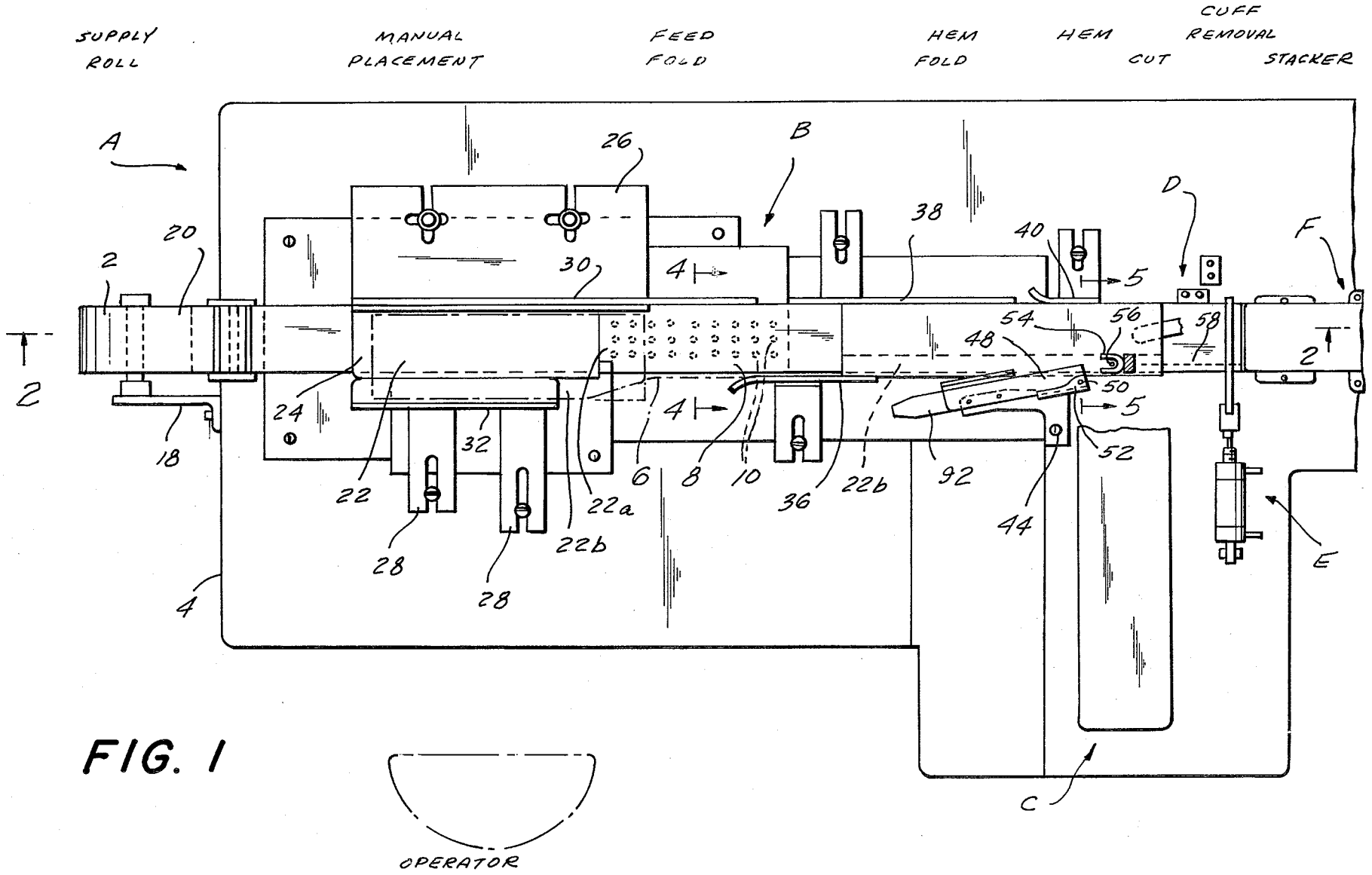
FIG. 1 is a top plan view of the improved hemming apparatus of the present invention, showing in detail the parts wherein feeding and positioning of the piece of material on the continuous liner band, folding the overlapping edges thereof and hemming the folded edge to the continuous band of material take place.

Using the manufacture of a shirt cuff to explain an exemplary application of the present invention, a supply roll of lining material is used rather than a bolt. The width of the roll is that of a conventionally used lining strip and it need only be cut at appropriate intervals to provide the proper cuff length. Thus, the tedious layout procedure involved with bolts of cloth is eliminated. As shown in FIG. 1, the band of lining material is unwound from a roll and passes over a support means, generally designated A, through a folder, generally designated B, to a sewing machine, generally designated, C. After it passes through the sewing machine, the band of lining material is fed past a sensing means generally designated, D, which controls a cutting mechanism, generally designated E, which cuts the band into strips. The cut strips are then stacked in a stacking apparatus generally designated F.

Previously prepared pieces of fabric are manually placed on top of the band at support means A. The sensing means D senses the passage of the trailing edge of each fabric strip after it has been hemmed to the band by sewing machine C. The cutting means E is actuated by sensing means D to cut the cuff away from the band. Stacking means F then removes the cuff from the cutting means E to a stack where a plurality of cuffs are stacked in a pile for easy removal by the operator.

From this rather basic description of the machine's operation, it can be seen that the only duties of the operator are to place the fabric pieces individually on top of the lining at the support means A and to remove the pile of cuffs from stacker F. Since the lining moves continuously, the cutter cuts automatically, and the stacker stacks automatically, there are no intervening, time consuming and skill requiring manual operations involved in the entire procedure. Consequently, the speed of production is considerably increased and the unit cost per cuff is considerably decreased.

Turning now to a more specific description of the present invention, as shown in FIG. 1, support means A includes a rotatable roll 2 of a band 20 of lining material which is mounted on a bracket 18 extending from one end of table 4. On table 4 is mounted an elongated suction enclosure 6. Enclosure 6 is attached to table 4 in a substantially airtight fashion and has a top plate 8 thereon which forms a portion of the supporting surface for the continuous liner band 20. Surface 8 is provided with a plurality of apertures or holes 10 along a section of its length. A tube 12 is inserted through hole 14 in table 4 and serves to put enclosure 6 in communication with a vacuum source 13. The suction produced by the vacuum source 13 operates to attract anything placed on top of that portion of surface 8 wherein holes 10 are situated toward the surface. Thus, as the band of lining material 20 unwinds from roll 2 and moves across surface 8 towards sewing maching C, it, as well as the strips of fabric 22 placed upon it by the operator, will be kept from being misaligned by accidental bumping of the machine, vibration or by the slight air disturbance produced when somebody passes by the machine and to which the light fabric may be susceptible. Such a misalignment may result in a faulty cuff.

Figure 2:
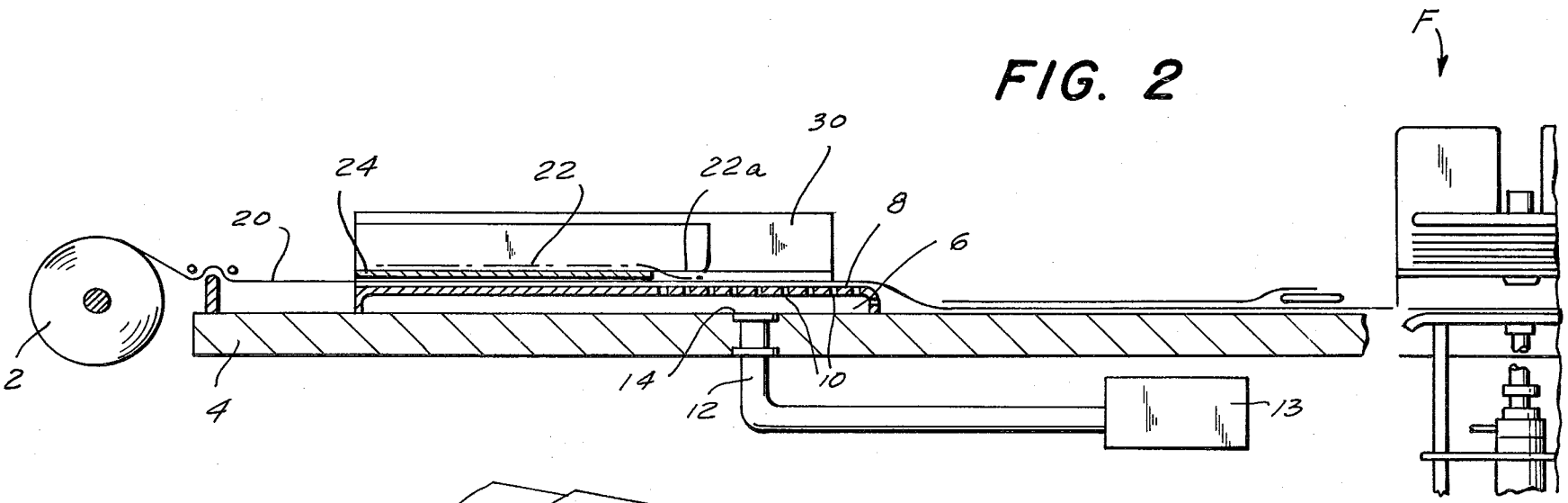
FIG. 2 is a sectional view of the apparatus taken along line 2—2 of FIG, 1.

As best seen in FIG. 2, a shelf-like surface 24 overhangs the forward end of enclosure 6 and is spaced from surface 8 by a distance sufficient to permit the continuous band of lining material 20 to pass therebetween. Surface 24 extends above enclosure 6 until the point on surface 8 where holes 10 are present. Surface 24 serves as a platform upon which the operator places the pieces of cuff material 22. As shown in the figures, the operator placed the piece of material 22 on surface 24 in such a manner that a portion thereof 22*a* overlaps the surface 24 and rests on band 20 which is situated on that portion of surface 8 having holes 10 therein. An adjustable guides 26, 28 are situated on table 4 on either side of surface 24 and are provided with upstanding portions 30 and 32, respectively, in order to assure that the operator places the piece of fabric 22 in the correct position relative to surface 24.

As the continuous band of lining material 20 is pulled through the machine by sewing machine C, portion 22*a* of the piece of material 20 which overlaps the surface 24 is held to the continuous band of material 20 by the action of the air flow through apertures 10. In this manner, the remainder of the piece of material 22 which was originally situated on surface 24 is automatically removed therefrom as continuous band 20 is moved. The appropriate positioning of the piece of material 22 with respect to the continuous band 20 is assured by means of guides 26 and 28.

In the machine described in the aforementioned patent, the pieces of fabric were placed on the continuous band which was located on the surface where holes 10 were positioned. Therefore, as soon as the piece of fabric was placed on the band, the relative positions therebetween were set by the force of the vacuum. There was no opportunity for the operator to move the piece of material with respect to the band in order to assure accurate relative positioning. This disadvantage is eliminated herein by having the operator place the piece of material 22 on surface 24 wherein the vacuum means is not active upon it. Once positioned correctly with respect to the guides 26 and 28, the piece of fabric 22 is moved so that portion 22*a* thereof overlaps surface 24 and is situated on the top of the continuous band 20 at a position such that the vacuum means is active thereon. The operator releases the piece of fabric 22 and as continuous band 20 is moved, portion 22*a* moves therewith causing the remainder of the piece of fabric 22 to be removed from surface 24. Guides 26 and 28 assure that the piece 22 is properly aligned with continuous band 20.

Figure 3:
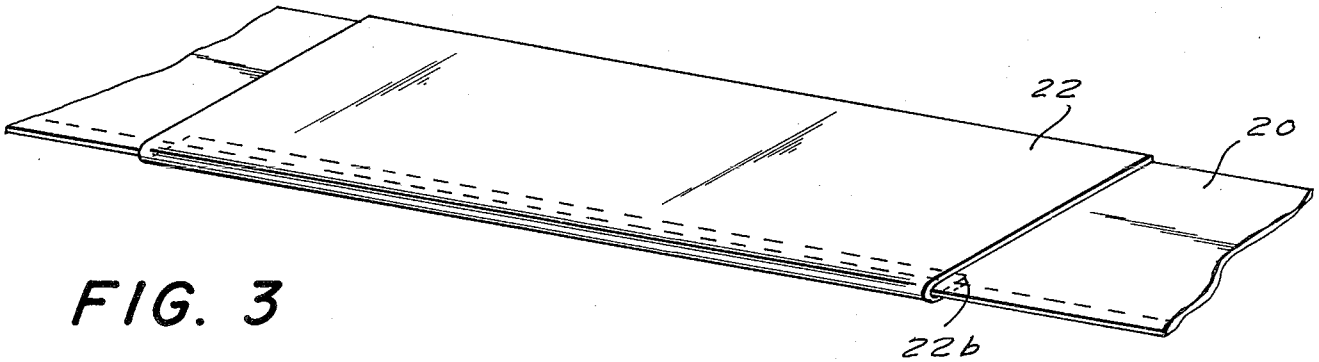
FIG. 3 is a perspective view of the continuous liner band as it appears after the sewing operation.

As best seen in FIGS. 1 and 4, guide 30 causes each piece of fabric 22 to have a portion of its width 22*b* overlapping the edge of band 20. It is this portion 22*b* of piece 22 which is to be folded around the edge of the continuous band 20 and thereafter sewn to form the hem, as shown in FIG. 3.

Folding takes place at that portion of enclosure 6 wherein holes 10 are situated on supporting surface 8. The upstanding wall 32 (See FIG. 4) of enclosure 6 which faces the operator and is immediately adjacent to the edge of support surface 8 is inclined inwardly to form a slot or opening 34 immediately below the edge of support surface 8 along the enclosure at that portion thereof adjacent to holes 10. Tube 12, which is connected to the vacuum means 13 directs the flow of air through slot 34. This air flow causes overlapping portion 22*b* to move from its outwardly projecting overhanging position, as shown in phantom in FIG. 4, to a folded position, as shown in solid in FIG. 4. It should be noted that the holes 10 in supporting surface 8 retain the piece of fabric 22 in the proper position with respect to continuous band 20 during the folding operation.

As band 20 is moved, the folded portion 22*b* of fabric 22 moves to the end of enclosure 6 the folded portion is moved past the end of that portion of surface 8 which was interposed between portion 22*b* and the end of band 20. As this is happening, upstanding bracket 36 which is adjustably mounted on table 4 and positioned adjacent the outer edge of fold assists in retaining the piece of fabric 22 in the folded condition. Thereafter, adjustably mounted upstanding guides 38 and 40 guide the band into the feed guide 42 for sewing machine C.

Feed guide 42 is connected to table 4 by means of a bracket 44. As shown in FIG. 1, guide 42 is placed at an acute angle with respect to the path of travel of continuous band 20 such that only a portion thereof is actually in contact with the continuous band 20. As seen in FIG. 5, the operative portion of guide 42 comprises a bottom surface 46 situated adjacent the top of table 4 and a top surface 48, which is spaced from surface 45 by a distance sufficient to permit a portion of continuous band 20 and fabric piece 22 with the now folded overlapping portion 22*b* to be inserted therebetween. A screw 50 is operatively connected to a bracket 52 to adjust the position of surface 48 with respect to surface 46.

As is readily apparent from FIG. 5, means 42 acts on the folded fabric 22 and band 20 in a manner which flattens out those surfaces of fabric 22 and continuous band 20 which are to be subsequently sewn by smoothing the wrinkles out and exerting a force to cause a crease along the fold line on faric 22. Further, this guide assures that the overlapping portion 22*b*, now folded underneath continuous band 20, is snug against the surface of band 20 to facilitate hemming.

From feed means 42, the continuous band 20 with the fabric pieces 22 folded therearound, passes to sewing machine C wherein foot 54 holds the material while needle 56 creates a hem 58 therein. After hemming, the continuous band passes adjacent to sensing means D which senses the trailing edge of material 22 and actuates cutting means E to cut the continuous band at the appropriate place. After cutting, the cut segments of lining band 20 with the fabric pieces folded and hemmed thereon are stacked in a stacking bin F.

The present invention is, therefore, an improved automatic hemming apparatus which facilitates the accurate positioning of pieces of material on the continuous lining band. Further, a vacuum folding apparatus is utilized such that the machine is adapted to be used with a relatively large range of dimensions of the continuous band and fabric pieces and, in addition, is suitable for producing cuffs of both the barrel (button) and French styles. The vacuum folding apparatus also permits a variation in the width of the overlapping portion of the fabric piece which is folded under the continuous band.

The machine performs these functions in a reliable, rapid and relatively inexpensive manner and requires no skilled labor for the operation thereof. It is, therefore, a completely automated hemming process which provides greater variety in the types and dimensions of material upon which it works and on the styles of the end products thereof than was heretofore thought possible.

While but only a single embodiment of the present invention has been herein specifically disclosed, it will be apparent that many variations and modifications may be made thereon. It is intended to cover all of these variations and modifications which fall within the scope of the instant invention as defined by the following claims.

We claim:

1. Apparatus for folding the overlapping portion of a first piece of material over the edge of a second piece of material, said apparatus comprising first and second adjoining surfaces, means for positioning the pieces of material on said first surface in a face-to-face relationship with the second piece adjacent said first surface, the edge of the second piece aligned with the end of said first surface and a portion of the first piece overlapping the edge of said second piece, said second surface having an opening therein, air flow means operably connected to said opening and effective to create a flow of air into said opening, said air flow causing said overlapping portion of the first piece to move towards said opening, be folded around said end of said first surface and, therefore, around the edge of the second piece.

2. The apparatus of claim 2 wherein said air flow means comprises vacuum means.

3. The apparatus of claim 1 further comprising means for retaining the first piece adjacent the second piece.

4. The apparatus of claim 3 wherein said retaining means comprises apertures in said first surface, said apertures being operably connected to said air flow means.

5. The apparatus of claim 1 further comprising means for moving the pieces of material along said first surface in a given direction.

6. The apparatus of claim 5 wherein said opening extends along said second surface in said given direction.

7. The apparatus of claim 1 wherein said positioning means comprises a third surface and a fourth surface, said third surface being situated above said fourth surface, and adapted to support the first piece of material, said fouth surface having the second piece of material thereon, the first piece being movable relative to said third surface to have a portion thereof overlapping said third surface and adjacent the second piece, means for retaining said portion of the first piece adjacent the second piece and means for moving the second piece to said first surface such that action of said retaining means causes the remaining portion of the first piece to be removed from said third surface.

8. The apparatus of claim 7 wherein said retaining means comprises apertures in said fourth surface, said apertures being operably connected to said air flow means.

9. The apparatus of claim 7 further comprising guide means for positioning said pieces relative to each other and to said end of said first surface.

10. The apparatus of claim 7 wherein said fourth surface is an extension of said first surface.

11. The apparatus of claim 1 further comprising abutment means for retaining said overlapping edge of the first piece folded around the second piece as the pieces are removed from said surface.

12. The apparatus of claim 11 wherein said abutting means comprises a surface situated to engage said overlapping edge in proximity of the fold line.

13. The apparatus of claim 1 wherein the second piece is a continuous band of material and further comprising means for feeding said continuous band to said first surface.

14. In combination with a sewing machine having a stitching means for sewing the folded portion of a plurality of first pieces of material, each resting on a continuous band, to one side of the band as it is being moved from a supply through the stitching means, and means for thereafter cutting said band into strips; an enclosure having first and second adjoining surfaces, means for feeding said pieces of material and said band to said first surface in a face-to-face relationship, with the edge of said band adjacent the end of said first surface and a portion of the piece overlapping the edge of the band, an opening along said second surface, air flow means operably connected to said enclosure and effective to create a flow of air into said opening, said air flow causing said overlapping portion of the piece to move towards said opening, be folded around said end of said first surface and, therefore, around the edge of said band, and means for feeding said band from said first surface to said stitching means.

15. The apparatus of claim 14 wherein said air flow means comprises a vacuum means.

16. The apparatus of claim 14 further comprising means for stacking said cut band strips.

17. The apparatus of claim 15 further comprising means for retaining the piece adjacent the band.

18. The apparatus of claim 17 wherein said retaining means comprises apertures in said first surface, said apertures being operably connected to said air flow means.

19. The apparatus of claim 14 further comprising means for moving said band along said first surface in a given direction.

20. The apparatus of claim 19 wherein said opening extends along said second surface in said given direction.

21. The apparatus of claim 14 wherein said feed means comprises a third surface, situated above said first surface, for supporting the piece of material, said first surface having the band thereon, the piece being situated on said third surface and movable relative thereto such that a portion thereof overlaps said third surface and is situated adjacent the band, means for retaining said portion adjacent band and means for moving the band such that action of said retaining means causes the remaining portion of the piece to be removed from said third surface.

22. The apparatus of claim 21 wherein said retaining means comprises apertures in said first surface, said apertures being operably connected to said air flow means.

23. The apparatus of claim 14 further comprising guide means for positioning the first piece and the band relative to each other and to said end of said first surface.

24. The apparatus of claim 14 further comprising abutment means for retaining said overlapping edge of the piece folded around the band as the band is removed from said folder.

25. The apparatus of claim 24 wherein said abutting means comprises a surface situated to engage said overlapping edge of the first piece in proximity to the fold line.

* * * * *